US006955566B2

(12) United States Patent
Matsunaga et al.

(10) Patent No.: US 6,955,566 B2
(45) Date of Patent: Oct. 18, 2005

(54) CARD CONNECTOR WITH A SLIDER HAVING A NON-FLAT PRESSING PART

(75) Inventors: Akihiro Matsunaga, Akishima (JP); Akira Natori, Fussa (JP); Keiichiro Suzuki, Kodaira (JP); Yoichi Kanao, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/744,343

(22) Filed: Dec. 23, 2003

(65) Prior Publication Data

US 2004/0137793 A1 Jul. 15, 2004

(30) Foreign Application Priority Data

Dec. 27, 2002 (JP) ..... 2002-381526

(51) Int. Cl.[7] ..... H01R 24/00

(52) U.S. Cl. ..... 439/630

(58) Field of Search ..... 439/630, 188, 439/159, 157, 325, 327; 235/441, 380; 710/1; 361/684

(56) References Cited

U.S. PATENT DOCUMENTS 6,095,868 A * 8/2000 Hyland et al. ..... 439/630
6,332,791 B1 * 12/2001 Wang et al. ..... 439/159

FOREIGN PATENT DOCUMENTS

| | | |
|---|---|---|
| EP | 1 073 006 | 1/2001 |
| JP | 09 293551 | 11/1997 |
| JP | 2000 260524 | 9/2000 |

* cited by examiner

*Primary Examiner*—Alexander Gilman
(74) *Attorney, Agent, or Firm*—Collard & Roe, P.C.

(57) ABSTRACT

In a connector (1) having a slider (4) movable in a predetermined direction (A1) with respect to a housing (2) to carry a card (11) to a particular position faced to a contact (3), the slider has a pressing part (4*a*) which is non-flat and elastically deformed to cause restring force while the card is carried towards the particular position. When the card is placed at the particular position, the pressing part presses the card towards the contact by the restoring force. It is preferable that the slider has a butting part (4*c*) to be brought into contact with a front end of the card and a locking part (4*b*) to be engaged with a rear end of the card. The pressing part may be formed into a plate-like shape with a protruding part (4*e*) formed at an intermediate portion in the predetermined direction to protrude towards the card.

6 Claims, 8 Drawing Sheets

CARD CONNECTOR WITH A SLIDER HAVING A NON-FLAT PRESSING PART

This application claims priority to prior Japanese application JP 2002-381526, the disclosure of which is incorporated herein by reference.

BACKGROUND OF THE INVENTION

This invention relates to a card connector with a slider for inserting and ejecting a card into and from the connector by sliding movement.

A connector of the type is disclosed, for example, in Japanese Patent Application Publication (JP-A) 2000-260524 and comprises an insulating housing and a plurality of contacts held by the housing. The housing is made of synthetic resin and is formed into a rectangular frame. A card is inserted into the housing through an opening formed on a front side thereof. When the card is inserted into the housing, each contact is brought into contact with a signal contact of the card. Thus, the card is connected to the connector.

In the state where the card is inserted in the housing, the card is pressed by elastic force of the contacts towards one surface of the housing and may possibly be deformed. Deformation of the card results in a reduced contacting pressure between the card and the contacts and may possibly cause contact failure.

In order to prevent the deformation of the card, a reinforcing part called a slider is used. Specifically, the card is placed on the slider and, in this state, inserted into the housing. Since the slider and the card are kept in a stacked state within the housing, the deformation of the card is suppressed to some extent owing to the rigidity of the slider. Therefore, it is possible to prevent the contact failure between the card and the contacts.

However, since the slider is substantially entirely flat plate-like member, the card may unexpectedly be released from the housing due to mechanical shock, vibration, or the like.

SUMMARY OF THE INVENTION

It is therefore an object of this invention to provide a card connector with a slider having a function of preventing the card from unexpectedly be released, in addition to reinforcement of a card.

Other objects of the present invention will become clear as the description proceeds.

According to an aspect of the present invention, there is provided a connector for use in connecting a card. The connector comprises a housing made of an insulator, a contact having conductivity and coupled to the housing, and a slider coupled to the housing and movable in a predetermined direction for carrying the card to a particular position faced to the contact. The slider has a pressing part which is non-flat and elastically deformed to cause restring force while the slider carries the card towards the particular position. The pressing part presses the card towards the contact by the restoring force when the card is placed at the particular position.

DESCRIPTION OF THE PREFERRED EMBODIMENTS

Figure 1:
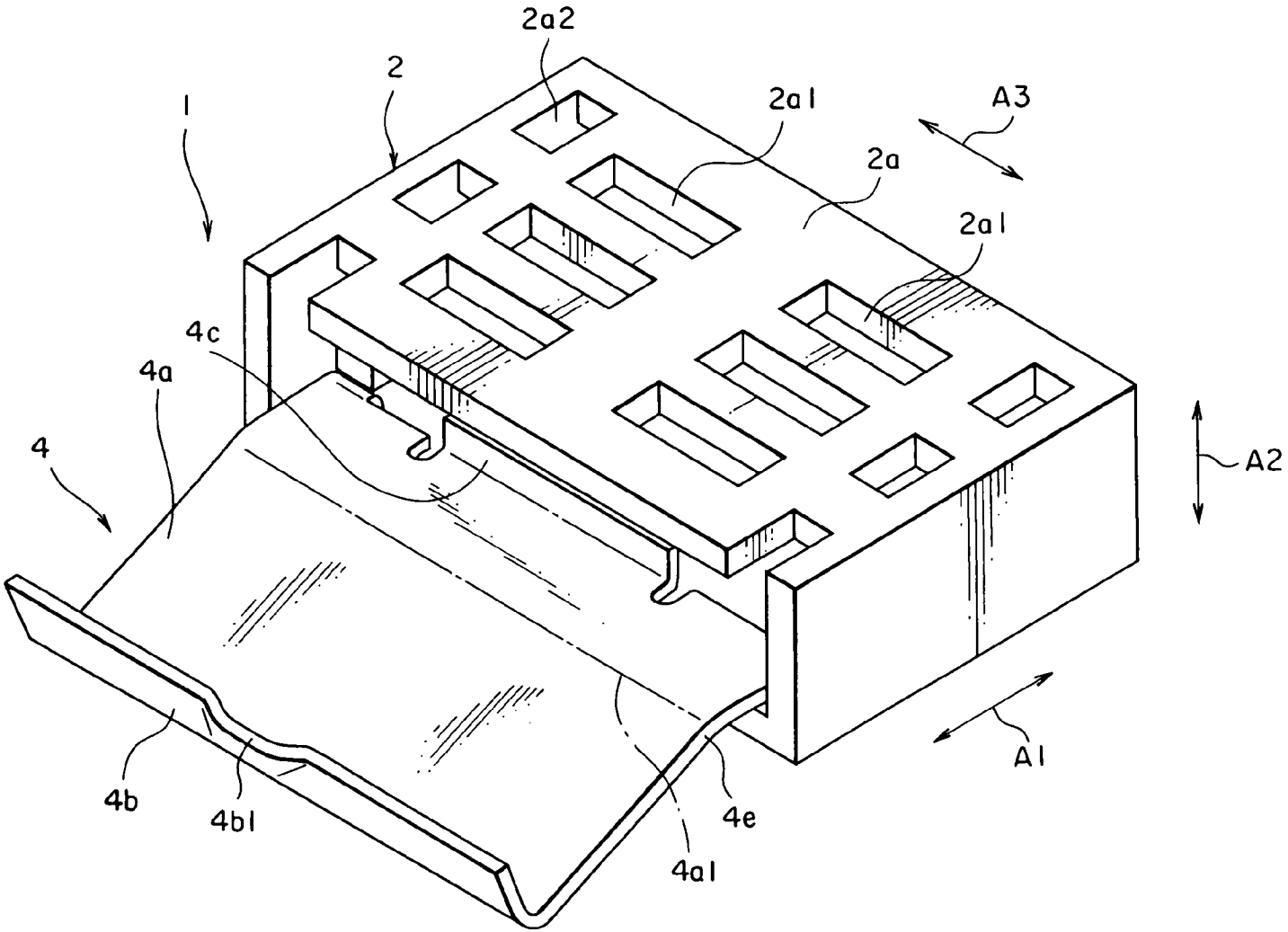
FIG. 1 is a perspective view of a card connector according to a first embodiment of this invention as seen from an upper side (in a state where a slider is pulled out from a housing)
Figure 2A:
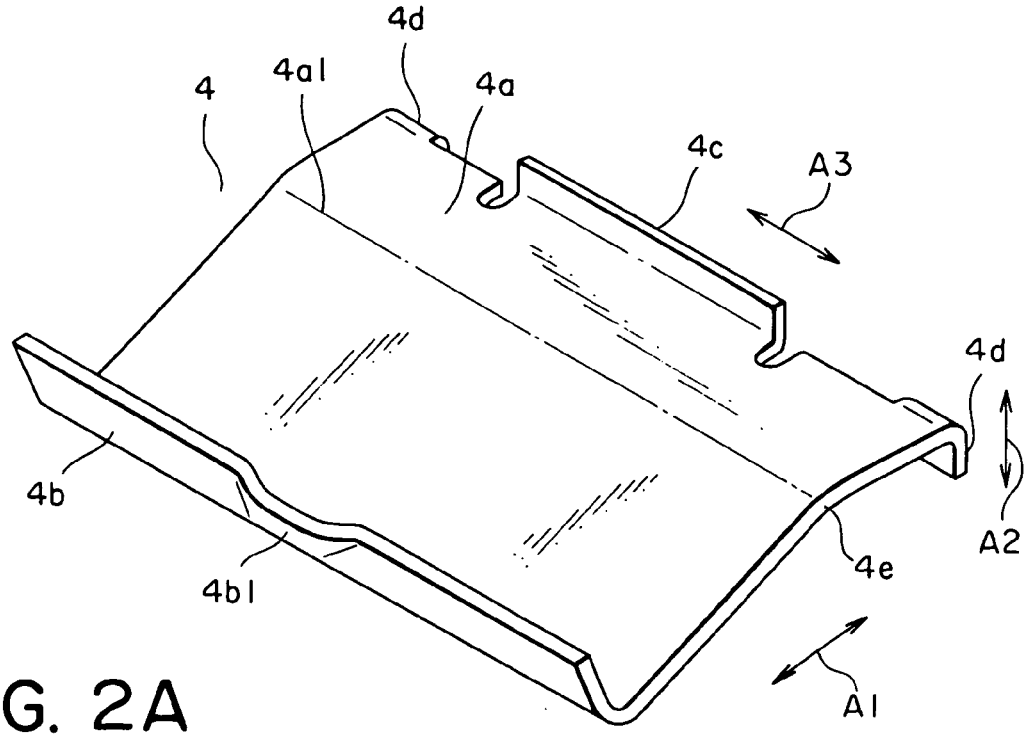
FIG. 2A is a perspective view of the slider of the card connector illustrated in FIG. 1 as seen from the upper side.
Figure 2B:
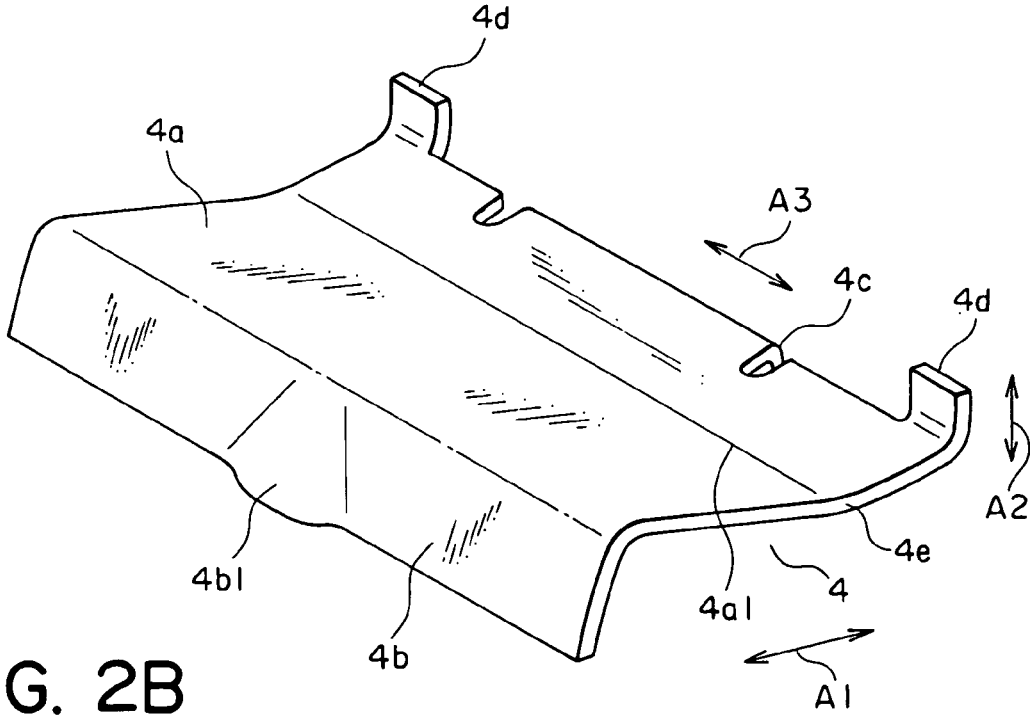
FIG. 2B is a perspective view of the slider of the card connector illustrated in FIG. 1 as seen from a lower side.

Referring to FIGS. 1 through 7, description will be made of a connector according to a first embodiment of this invention.

The connector 1 illustrated in the figure is adapted to be used to connect a card 11, such as an IC (Integrated Circuit) card, a SIM (Subscriber Identity Module) card, a MMC (MultiMedia Card), a SD (Secure Digital) card, and a memory stick. The card 11 has an upper or first surface 11*a*, a lower or second surface 11*b* opposite to the first surface 11*a*, and front and rear ends 11*c* and 11*d* adjacent to the first and the second surfaces and opposite to each other. Plural signal contacts 12 are formed on the first surface 11*a* of the card 11.

The connector 1 comprises a housing 2 made of an insulator, a plurality of contacts (see FIGS. 6 and 7) 3 having elasticity and conductivity and coupled to the housing 2, and a slider 4 coupled to or engaged with the housing 2 and slidable along the housing 2 in a predetermined or first direction A1 for carrying the card 11 to a particular position faced to the contacts 3.

The slider 4 is produced from a metal plate elastically deformable and has an integral structure including a pressing part 4*a* of a plate-like but non-flat shape, a locking part 4*b* connected to a first end of the pressing part 4*a* in the first direction A1 and upwardly bent therefrom in a second direction A2 perpendicular to the first direction A1, a butting part 4*c* connected to a second end opposite to the first end of the pressing part 4*a* in the first direction A1 and upwardly bent therefrom in the second direction A2, and a pair of engaging parts 4*d* connected to the second end of the pressing part 4*a* and downwardly bent therefrom in the second direction A2. It is noted that the butting part 4*c* is located at a center portion of the second end of the pressing part 4*a* and that the engaging parts 4*d* are located at both sides of the butting part 4*c* in a third direction perpendicular to the first and the second directions A1 and A2.

The pressing part 4*a* serves to bring the card 11 into contact with the contacts 3 held by the housing 2. The pressing part 4*a* is bent at its intermediate portion in the first direction A1 and formed into a mountain-like or angled shape having a ridge at a bent position 4*a*1. Thus, the pressing part 4*a* has a ridge portion or a protruding part 4*e* protruding at the intermediate portion in the first direction A1 towards the card 11.

The locking part 4*b* serves to prevent the card 11 from being undesiredly released from the connector 1. More particularly, the locking part 4*b* is engaged with the rear end 11*d* of the card 11 to prevent the card 11 from being undesiredly released and escaped from the housing 2 of the connector 1. The locking part 4*b* is displaceable over a retreating distance D (see FIGS. 4 and 6). The locking part 4*b* is provided with a pull-out part 4*b*1 formed at its center to be engaged by a finger of a user or an operator in order to remove the card 11 from the connector 1.

The butting part 4*c* is pressed by the front end 11*c* of the card 11 in an early stage of insertion of the card 11 into the connector 1 and presses the forward end of the card 11 in a stage of ejecting the card 11 from the connector 1.

Figure 6:
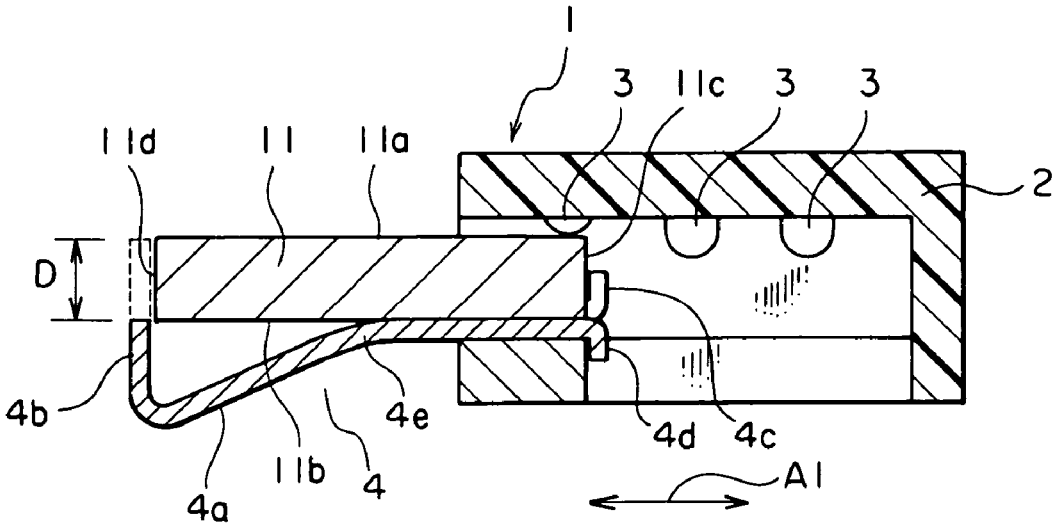
FIG. 6 is a sectional view of the card connector in FIG. 1 in the state where the card is placed on the slider.
Figure 7:
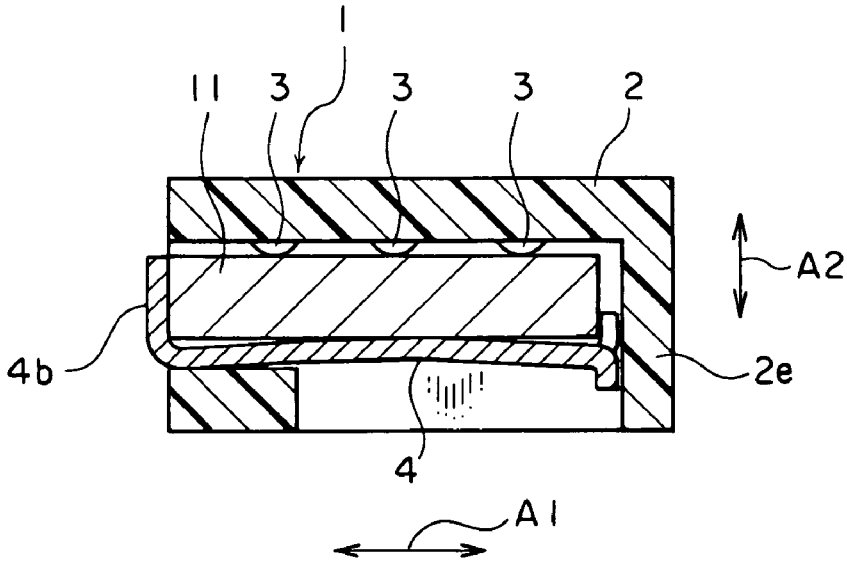
FIG. 7 is a sectional view taken along a line VII—VII in FIG. 5.

As illustrated in FIG. 6, the engaging parts 4*d* serves to prevent the slider 4 from being released from the housing 2 immediately before the card 11 is inserted and immediately after the card 11 is ejected.

Figure 3A:
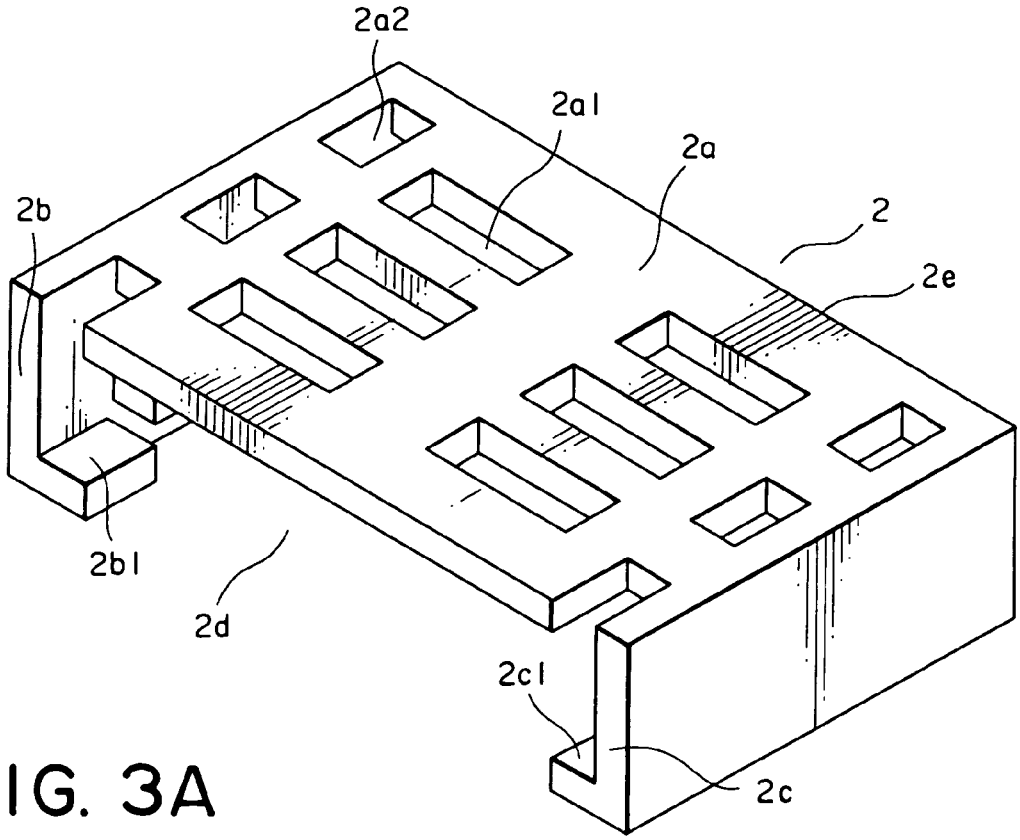
FIG. 3A is a perspective view of the housing of the card connector in FIG. 1 as seen from the upper side.
Figure 3B:
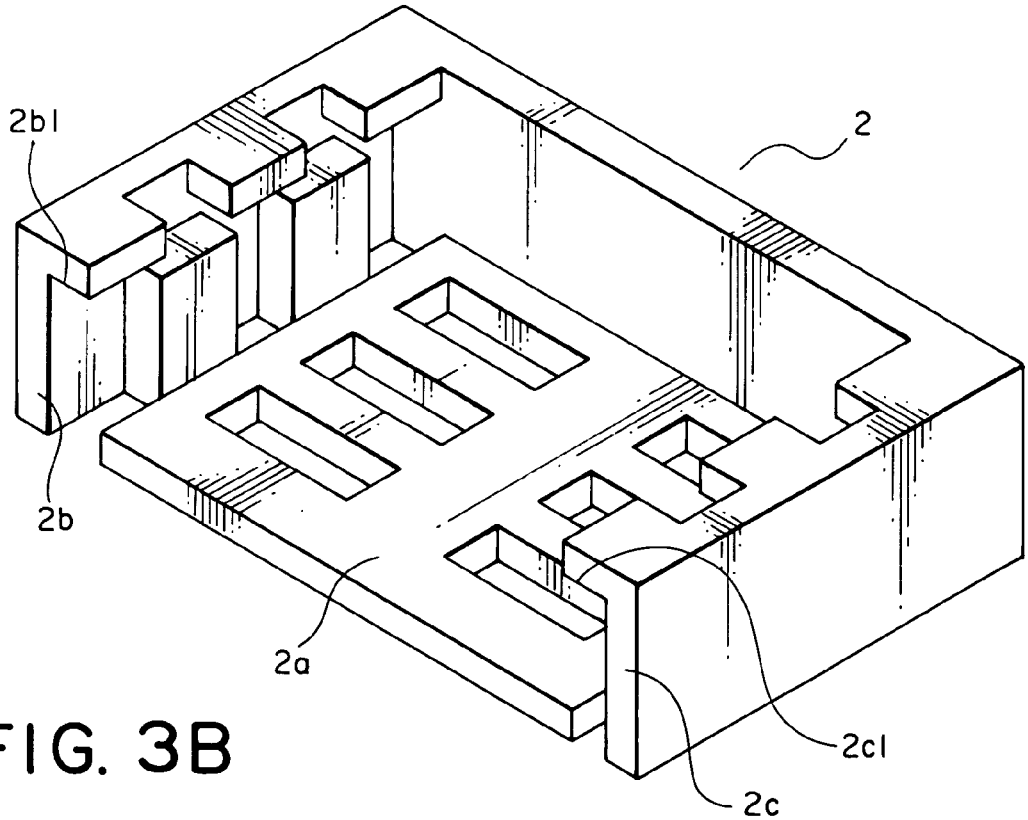
FIG. 3B is a perspective view of the housing in FIG. 3A as seen from the lower side.

Particularly referring to FIG. 3, the housing 2 will be described.

The housing 2 is produced from synthetic resin into a rectangular frame. The housing 2 has a top plate 2*a* provided with six rectangular holes 2*a*1 formed in its center area to be press-fitted with the six contacts 3 (see FIG. 6) and two die-molding holes 2*a*2 formed on each of the left and the right sides thereof. Further, the housing 2 has left and right opposite side plates 2*b* and 2*c* provided with three receiving or seating parts 2*b*1 and three receiving or seating parts 2*c*1, respectively. The receiving parts 2*b*1 and 2*c*1 are parallel to the top plate 2*a* and adapted to receive the slider 4. The slider 4 is inserted through an opening 2*d* formed on a front side of the housing 2 and butted to a rear plate 2*e* to be stopped (see FIG. 7). The contacts 3 may be coupled to the top plate 2*a* by insert molding.

Next, description will be made of insertion of the card 11 into the connector 1 and ejection of the card 11 from the connector 1.

Figure 4:
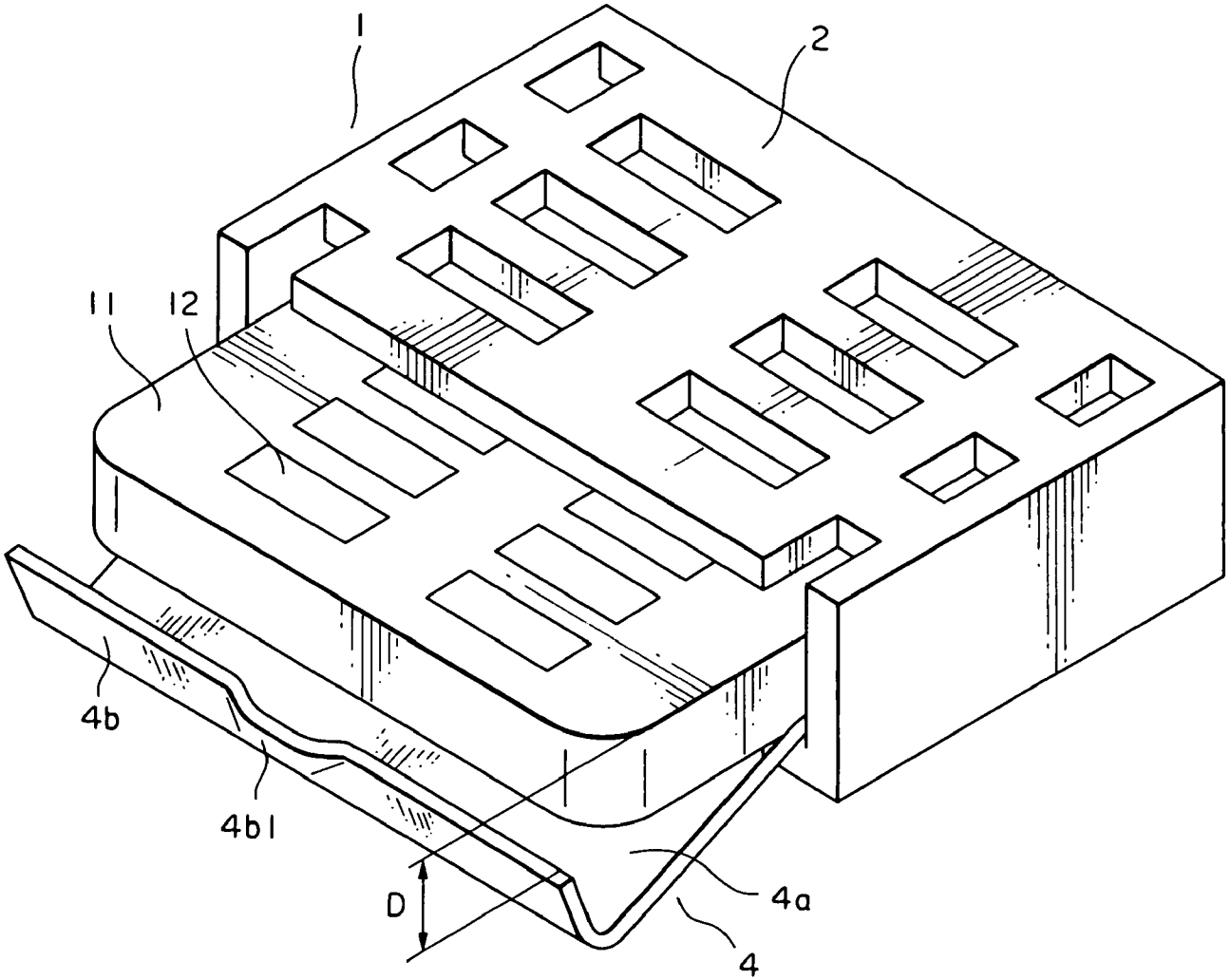
FIG. 4 is a perspective view of the card connector in FIG. 1 in the middle of insertion of the card.
Figure 5:
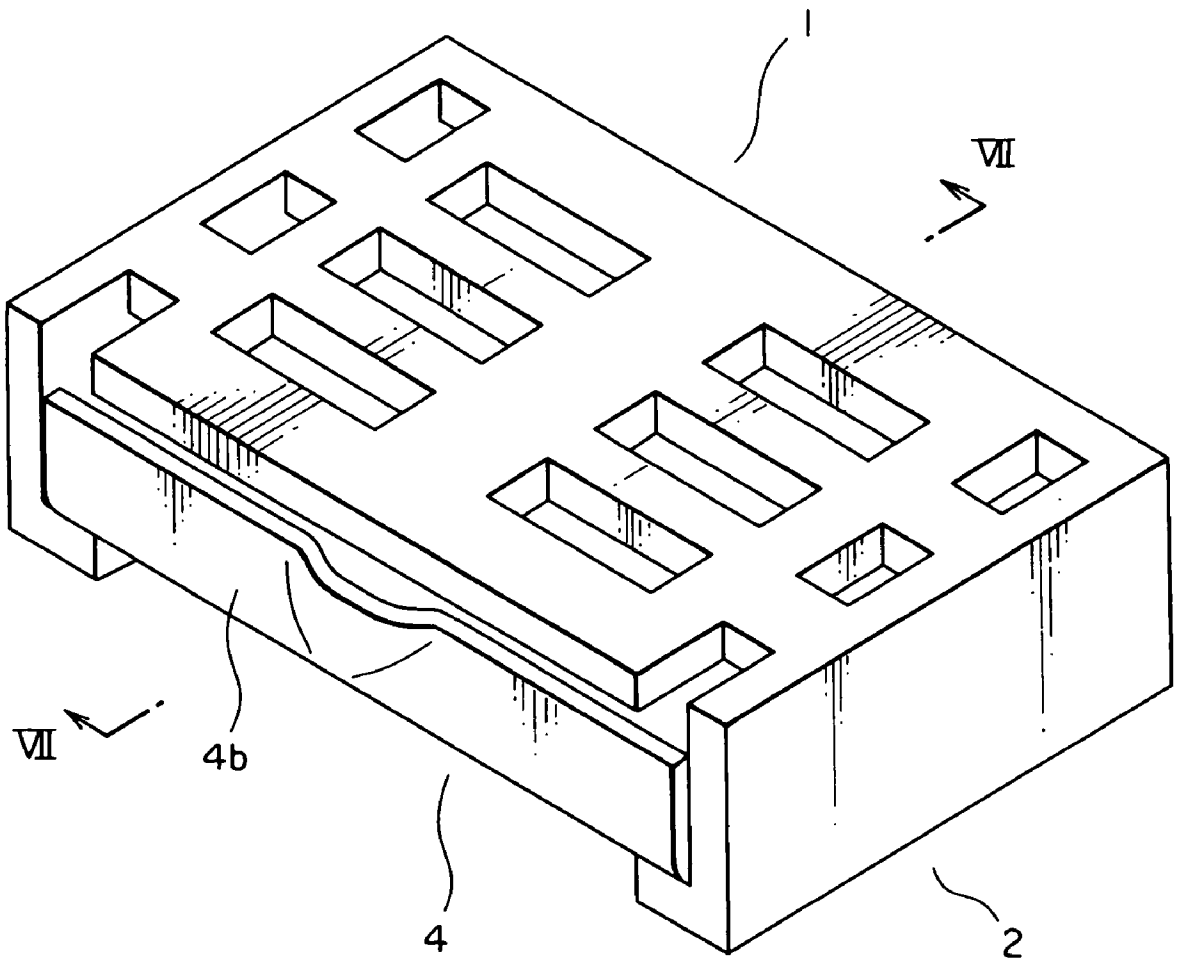
FIG. 5 is a perspective view of the card connector in FIG. 1 in the state where the slider, together with the card, is completely inserted into the housing.

The slider 4 is pulled out from the housing 2 as illustrated in FIG. 1 and the card 11 is placed on the pressing part 4*a* of the slider 4. Then, the state illustrated in FIG. 6 is obtained. When the rear end 11*d* of the card 11 is slightly pressed in the first direction A1, the front end 11*c* of the card 11 presses the butting part 4*c* of the slider 4. Then, the state in FIG. 4 is reached.

When the rear end 11*d* of the card 11 is further pressed towards the connector 1, a rear surface of the pressing part 4*a* of the slider 4 is brought into press contact with the receiving parts 2*b*1 and 2*c*1, six in total, of the housing 2. Consequently, the pressing part 4*a* is elastically deformed to displace the locking part 4*b* upward over the retreating distance D. As a result, the locking part 4*b* is moved to a position depicted by a dotted line in FIG. 6. In addition, the pressing part 4*a* causes restring force therein while the slider 4 carries the card 11 towards the above-mentioned particular position.

Thereafter, the locking part 4*b* is pushed and advanced towards the connector 1. Then, the rear end 11*d* of the card 11 is pressed by the locking part 4*b*. When the butting part 4*c* and the engaging parts 4*d* of the slider 4 are butted to the rear plate 2*e* of the housing 2, the slider 4 and the card 11 are stopped in the state illustrated in FIG. 7.

At this time, the card 11 is placed at the particular position and is pushed upward by the restoring force of the pressing part 4*a* of the slider 4. Therefore, the signal contacts 12 (see FIG. 4) of the card 11 are brought into press contact with the contacts 3 held by the housing 2, respectively. In other words, the pressing part 4*a* presses the second surface 11*b* of the card 11 towards the contacts 3 by the restoring force. Then, the contacts 3 are pressed and elastically deformed. Thus, the card 11 is electrically connected to the connector 1.

In order to eject the card 11 from the connector 1, the pull-out part 4*b*1 of the slider 4 is engaged by the finger and the slider 4 is pulled out from the housing 2. Then, the butting part 4*c* presses the front end 11*c* of the card 11 so that the card 11, together with the slider 4, is ejected from the connector 1.

Figure 8A:
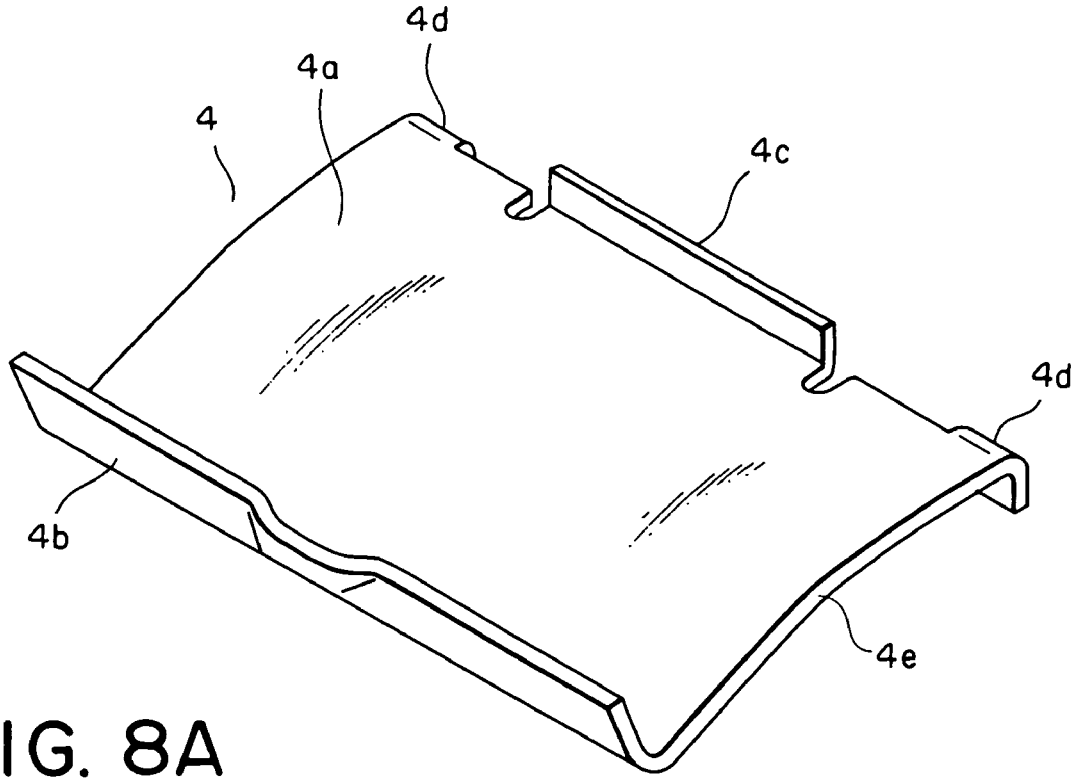
FIG. 8A is a perspective view of a modification of the slider as seen from the upper side.
Figure 8B:
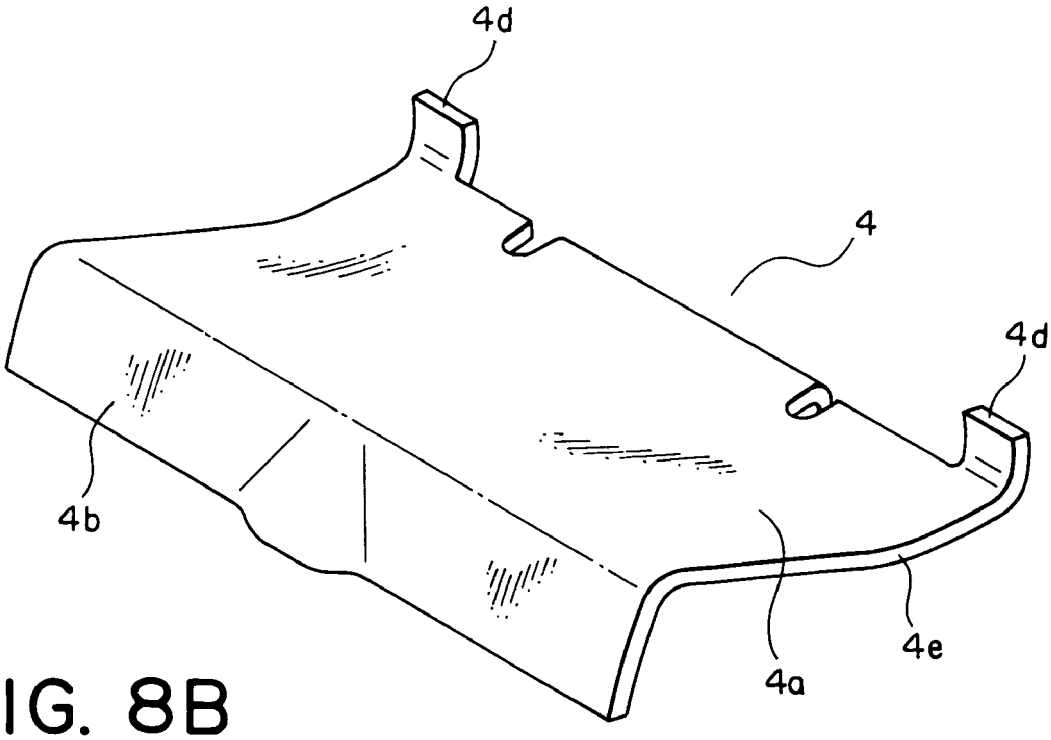
FIG. 8B is a perspective view of the slider illustrated in FIG. 8A as seen from the lower side.

Referring to FIGS. 8A and 8B, a modification of the slider 4 will be described.

The slider 4 illustrated in FIGS. 8A and 8B is modified in design of the pressing part 4*a*. The pressing part 4*a* has a continuously curved surface. In other words, the protruding part 4*e* is formed by curving the pressing part 4*a*.

Figure 9:
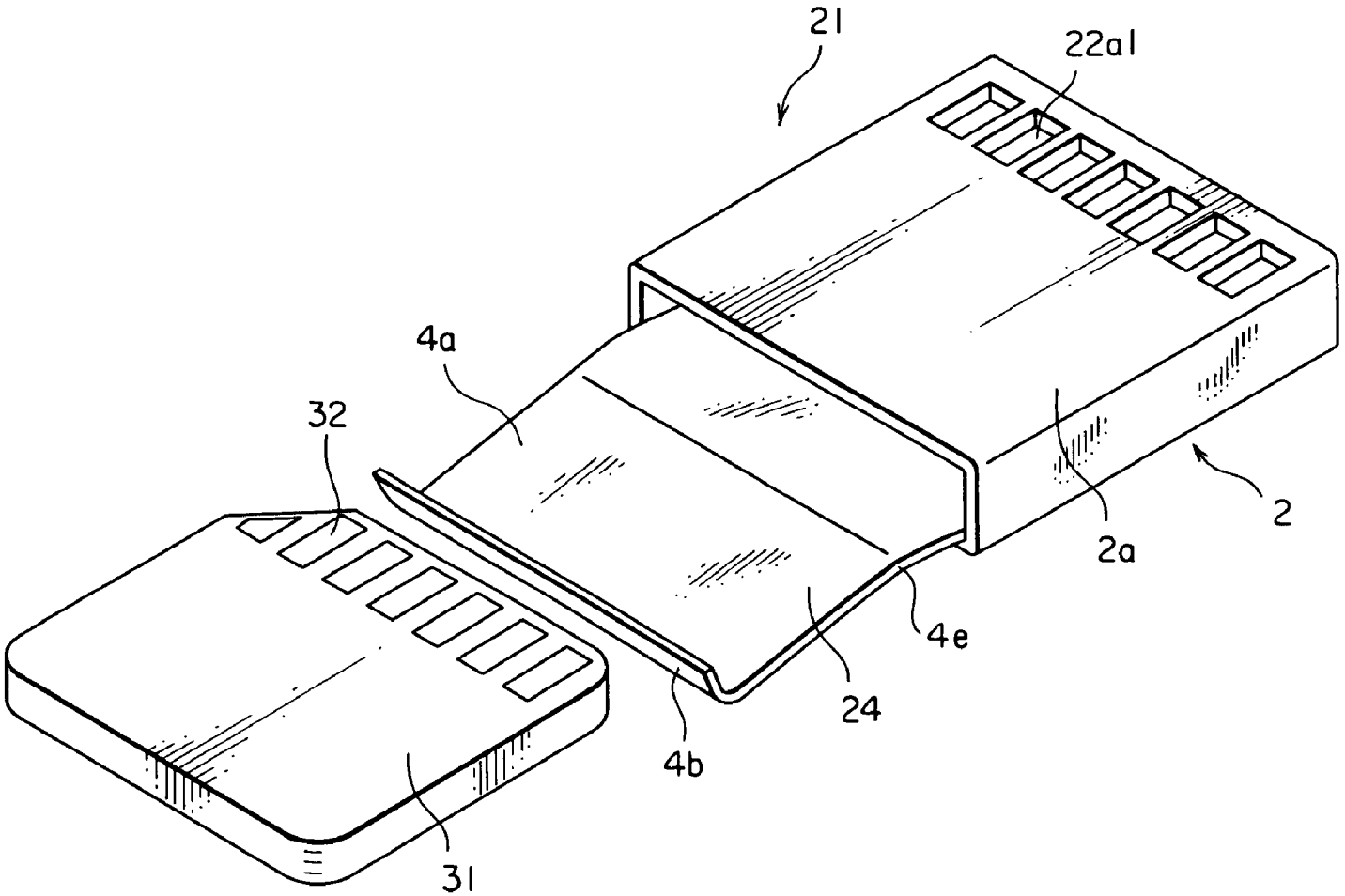
FIG. 9 is a perspective view of a card connector according to a second embodiment of this invention in the state where a slider is pulled out from a housing.

Next referring to FIG. 9, description will be made of a card connector according to a second embodiment of this invention. Similar parts are designated by like reference numerals and description thereof will be omitted.

A card 31 is provided with a plurality of signal contacts 32, seven in number, formed on its surface in the vicinity of its forward end. On the other hand, the card connector 21 is provided with rectangular holes 2*a*1, seven in number, formed on the top plate 2*a* of the housing 2 on the rear side. Although not shown in the figure, conductive contacts are disposed in the rectangular holes 2*a*1, respectively, like in the card connector 1 illustrated in FIGS. 1 through 7.

The pressing part 4*a* of the slider 4 has the protruding part 4*e* formed by a bent plane or a continuously curved plane. When the card 31 is brought into press contact with the contacts held by the housing 2, the pressing part 4*a* prevents the deformation of the card 31.

While the present invention has thus far been described in connection with a few embodiments thereof, it will readily be possible for those skilled in the art to put this invention into practice in various other manners. For example, the top surface of the pressing part 4*a* may be modified in design into any other appropriate shape, for example, a composite or complex surface comprising a combination of a flat plane and a curved plane. Further, the contacts may be held by an additional member or an additional device separate from the housing and brought into contact with the signal contacts of the card through openings formed in the housing.

What is claimed is:

1. A connector for use in connecting a card, the connector comprising:

a housing made of an insulator;

a contact having conductivity and coupled to the housing; and a slider coupled to the housing and movable in a predetermined direction for carrying the card to a particular position faced to the contact, the slider having a pressing part which is non-flat and elastically deformed to cause restoring force while the slider carries the card towards the particular position, the pressing part pressing the card towards the contact by the restoring force when the card is placed at the particular position, and the card having a first surface to be faced to the contact and a second surface opposite to the first surface, the pressing part receiving the card to face the second surface, the card further having a front end and a rear end adjacent to the first and the second surfaces, the front and the rear ends being opposite to each other in the predetermined direction, the slider having:

a butting part connected to the pressing part and adapted to be brought into contact with the front end of the card; and a locking part connected to the pressing part and adapted to be engaged with the rear end of the card.

2. The connector according to claim 1, wherein the locking part has a pull-out part having a shape adapted to be engaged by a finger.

3. The connector according to claim 1, wherein the slider further has two engaging parts connected to the pressing part and spaced from each other, the engaging parts being engaged with the housing to prevent the slider from being released from the housing, the butting part being disposed between the engaging parts.

4. The connector according to claim 1, wherein the slider has an engaging part connected to the pressing part and adapted to be engaged with the housing to inhibit the slider from being released from the housing.

5. The connector according to claim 1, wherein the pressing part has a plate-like shape and has a protruding part formed at an intermediate portion in the predetermined direction and protruding towards the card.

6. The connector according to claim 1, wherein the housing has a top plate provided with a hole, the contact being held by the housing via the hole.

* * * * *